US007279681B2

(12) United States Patent
Li et al.

(10) Patent No.: US 7,279,681 B2
(45) Date of Patent: Oct. 9, 2007

(54) ION TRAP WITH BUILT-IN FIELD-MODIFYING ELECTRODES AND METHOD OF OPERATION

(75) Inventors: Gangqiang Li, Palo Alto, CA (US); Alexander Mordehai, Santa Clara, CA (US)

(73) Assignee: Agilent Technologies, Inc., Santa Clara ( * ) Notice: Subject to any disclaimer, the term of this patent is extended or adjusted under 35 U.S.C. 154(b) by 287 days.

(21) Appl. No.: 11/157,906

(22) Filed: Jun. 22, 2005

(65) Prior Publication Data

US 2007/0023646 A1 Feb. 1, 2007

(51) Int. Cl.
*H01J 49/42* (2006.01)

(52) U.S. Cl. ..... 250/292

(58) Field of Classification Search ..... 250/292
See application file for complete search history.

(56) References Cited

U.S. PATENT DOCUMENTS

| | | | | |
|---|---|---|---|---|
| 5,468,958 | A | 11/1995 | Franzen et al. | |
| 5,650,617 | A | 7/1997 | Mordehai | |
| 6,087,658 | A | 7/2000 | Kawato | |
| 6,157,030 | A * | 12/2000 | Sakairi et al. | 250/292 |
| 6,297,500 | B1 | 10/2001 | Franzen et al. | |
| 6,608,303 | B2 | 8/2003 | Amy et al. | |
| 6,911,651 | B2 * | 6/2005 | Senko et al. | 250/292 |
| 7,019,289 | B2 * | 3/2006 | Wang | 250/290 |
| 2005/0061966 | A1 * | 3/2005 | Ding et al. | 250/288 |

* cited by examiner

*Primary Examiner*—Jack I. Berman

(57) ABSTRACT

An apparatus and method for correcting deviations in a quadrupole field in a quadrupole ion trap is provided. More specifically the invention provides for correction electrodes positioned in at least one primary quadrupole electrode and a method of using the correction electrodes to provide a field correction potential.

20 Claims, 5 Drawing Sheets

ION TRAP WITH BUILT-IN FIELD-MODIFYING ELECTRODES AND METHOD OF OPERATION

FIELD OF THE INVENTION

The invention generally relates to quadrupole ion traps and more particularly to an apparatus and method for field corrections in quadrupole ion traps.

BACKGROUND OF THE INVENTION

Three dimensional quadrupole ion traps (e.g., 3-D ion traps) are commercially available devices used as mass spectrometers. A 3-D ion trap can be used as single mass analyzer or as a tandem mass spectrometer. A linear quadrupole (e.g., 2-D ion trap) is another commercially available quadrupole device that can be used as a mass analyzer, and/or an ion storage component and/or as an ion collision cell for a tandem mass spectrometer. Typically, ions and/or molecules are introduced in both the 3-D and the ion trap 2-D via an aperture.

In both the 3-D ion trap and the linear quadrupole, the presence of the aperture inevitably introduces some deviation into the quadrupole field (e.g., an ideal quadrupole potential no longer exists). This deviation often negatively impacts the performance of the quadrupole. For example, the deviation may cause peak splitting, mass shifting and/or a decrease in mass resolution.

U.S. Pat. No. 6,087,658 discloses addressing this problem by modifying the hyperbolic surface by constructing a bulge around the internal end of each aperture. The bulge is intended to correct the deviation of the pure quadrupole field caused by the holes (e.g. apertures) in the end caps. It is technically difficult to add such a bulge to an ideal hyperbolic surface. Further, once the surface is modified to include the bulge, the distribution of the quadrupole potential is determined and there is typically no convenient way to change or adjust it.

U.S. Pat. No. 6,608,303 discloses the use of an aperture shim electrode placed in the aperture to correct the deviation. A shim lens power supply provides a different RF voltage for the shim electrode than for the primary electrode which permits a correction of the quadrupole field deviation caused by the presence of the aperture. A shim electrode with an additional power supply provides the possibility of altering the potential distribution including altering the potential distribution as the ion trap is used. However, placement of a shim electrode in the aperture is limited by the aperture size. Also, the shim electrode affects potential distribution in the region immediately around the aperture but has less influence elsewhere.

U.S. Pat. No. 5,650,617 also describes using an aperture shim electrode in the aperture to improve ion trapping for the externally produced ions.

U.S. Pat. No. 5,468,958 describes a sectional ion trap composed of multiple rings of cylindrical symmetry to introduce higher order multiple fields which can be tuned electronically. The sectional ion trap has the disadvantage of being difficult to make. Further, it is typically difficult to maintain the correct geometry between its sectional electrodes.

Accordingly, there is a need for reducing the deviations in the quadrupole field.

SUMMARY OF INVENTION

The apparatus described includes a quadrupole ion trap comprising a plurality of primary electrodes defining a trapping volume. In one embodiment, at least one of the primary electrodes has an aperture and at least one curved surface, the curved surface positioned adjacent the trapping volume. Also the apparatus includes at least one correction electrode. The correction electrode is positioned within the primary electrode having an aperture such that a portion of the primary electrode is interposed between the aperture and correction electrode.

The quadrupole ion trap may further comprise a supplemental voltage source to the correction electrode. The supplemental voltage source is operable to apply a supplemental voltage to the correction electrode. The supplemental voltage may be adjustable. One or more ring electrodes or a plurality of strip electrodes or a combination thereof may be used as the correction electrode.

A method for improving the quadrupole potential distribution is disclosed. The method comprises providing a quadrupole ion trap comprising a plurality of primary electrodes defining a trapping volume in which at least one of the primary electrodes has an aperture and at least one correction electrode positioned in the primary electrode having an aperture such that a portion of the primary electrode is interposed between the aperture and correction electrode, and applying a supplemental voltage to the correction electrode. The supplemental voltage has an adjustment means that provides for adjusting the supplemental voltage to a voltage different from a voltage applied to the primary electrode.

DETAILED DESCRIPTION OF THE DRAWINGS

DETAILED DESCRIPTION OF THE INVENTION

Figure 1:
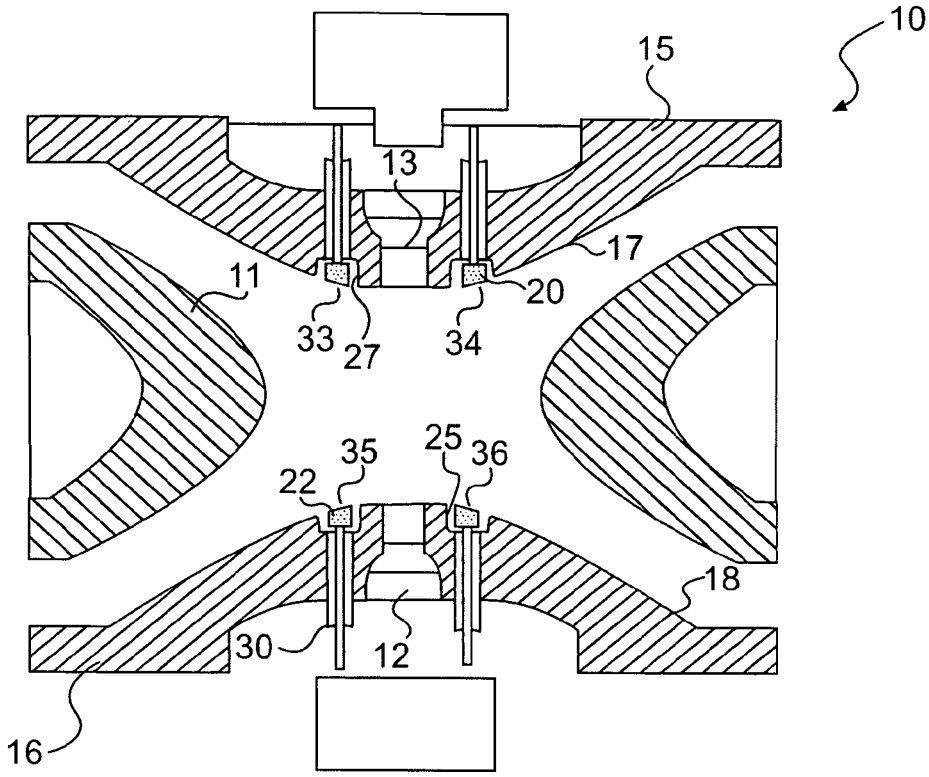
FIG. 1 is a schematic cross section diagram of one embodiment of a 3-D ion trap of the invention.

Typically, 3-D ion traps and linear quadrupoles are constructed with close to an ideal hyperbolic surfaces for the surfaces of the quadrupole that faces the trapping volume of the ion trap. The hyperbolic surface facilitates generation of a near ideal quadrupole potential. The ideal quadrupole potential is derived from the equations:

$\Phi=\Phi_0(x^2-y^2)/2r_0^2$ for a linear quadrupole, or $\Phi=\Phi_0(r^2-2z^2)/2r_0^2$ for a 3-D ion trap, where $\Phi_0$ is the potential applied to the end cap electrode or quadrupole rod surface and $r_0$ is the inner dimension of the quadrupole, respectively. The performance of the 3-D ion trap and linear quadrupole are largely determined by the potential distribution inside the quadrupole field. Thus, perturbations in the surface of the end cap or rod impact the quadrupole field and potentially the performance.

Typically, in a 3-D ion trap mass spectrometer, ions are produced in an external ion source and then the ions are brought into the ion trap. For mass analysis, the ions are ejected from the trap and detected with an ion detector also located outside the ion trap. In order to introduce and extract ions into and from the ion trap, entrance and exit aperture holes are needed in the primary quadrupole end cap electrodes. These holes are usually placed at the center of the end caps. For linear quadrupoles used as collision cells, additional ions and/or molecules are needed to facilitate ion-ion or ion molecule reactions. These ions and/or molecules are brought into the quadrupole field by using a radial injection technique. Radial injection typically requires providing an aperture by cutting a slot into one of the quadrupole rods to form an aperture for admission of ions and/or molecules.

The described apparatuses and methods reduce deviations in a quadrupole field in a quadrupole ion trap, caused by the presence of an aperture in a primary quadrupole electrode. The invention is applicable to both 3-D ion traps and linear quadrupole ion traps and provides for improved quadrupole potential distribution. (Primary quadrupole electrodes include the electrodes that generate the primary quadrupole field in a quadrupole ion trap and may include, for example, rod electrodes, end cap electrodes, ring electrodes and the like.)

More specifically, the invention includes the use of one or more correction electrodes mounted in a primary electrode having an aperture at a position such that a portion of the primary electrode is interposed between the correction electrode and the aperture. The potential deviation in a quadrupole field due to the presence of an aperture is corrected by applying a voltage to the correction electrode. In one exemplary embodiment, the correction electrode has a hyperbolic curved surface with the same curvature as the quadrupole electrode with an aperture. In this embodiment, the curvature of the correction electrode is aligned with the curvature of the primary electrode. In the other embodiment, the potential deviation is corrected using a correction electrode, which is located below or above the hyperbolic surface of the primary electrode. In this embodiment, the requirements for the correction electrode geometry and geometrical dimensions are typically more flexible then for correction electrodes which have a curved surface that is aligned with the curved surface of the primary electrode.

The correction electrode device is not limited by the size of the aperture in the primary electrode. Further, the use of a separate power supply for the correction electrode (or electrodes) provides for adjustability of the correction potential. In some embodiments, multiple correction electrodes can be placed in the primary electrode to provide additional flexibility in controlling the potential distribution. Optionally, correction electrodes can be made as a part of one or more printed circuit boards mounted within the primary electrode thus providing an economic way to correct the field.

Mass resolving power can be improved with the correction device and correction method. In some exemplary applications high mass resolving power can be achieved.

FIG. 1 shows a cross sectional view of an exemplary embodiment of a 3-D ion trap. The trap 10 has primary electrodes, e.g., end cap electrodes 15, 16 and primary annular electrode 11. The end cap electrodes 15, 16 each have a hyperbolic surface 17, 18, respectively. The end cap electrodes 15, 16 have apertures 12, 13. Correction electrodes 20, 22 are positioned in the end cap electrodes 15, 16, respectively, such that a portion of the end cap electrode 15, 16 is interposed between the correction electrodes 20, 22 and apertures 12, 13. In this embodiment, correction electrodes 20, 22 are ring correction electrodes. Accordingly, correction electrode portions 33, 34 are portions of ring correction electrode 20 and electrode portions 35, 36 are portions of ring correction electrode 22.

For the embodiment illustrated in FIG. 1 circular scores are cut into the hyperbolic surface of the end cap electrodes 15, 16 forming a groove in each end cap. The grooves 25, 27 are aligned to be coaxial with the apertures 12, 13, respectively. The ring correction electrodes 20, 22 in this exemplary embodiment are ring correction electrodes with a hyperbolic surface. The ring correction electrodes 20, 22 are placed in the grooves 25, 27 such that the hyperbolic surface of the ring correction electrodes 20, 22 are aligned with the curvature of the surfaces 17, 18 of the end cap electrodes 15, 16. The ring correction electrodes 20, 22 are electrically isolated from the end cap electrodes 15, 16. A plurality of pins 30 are mounted on the backside of the ring correction electrodes 20, 22 and extend through holes drilled in the end cap electrodes 15, 16. The pins facilitate holding the ring correction electrodes 20, 22 in place and provide for electrical connection between the ring correction electrodes 20, 22 and a supplemental voltage supply. Pins are exemplary of a suitable means for connecting to the supplemental voltage supply. Other means for accomplishing the connection are likewise suitable.

A conventional RF waveform is typically applied to the end cap electrodes 15, 16 to generate the main quadrupole potential. A separate voltage supply connected to the ring correction electrodes 20, 22 is used to create an additional correction potential. The voltage applied to the ring correction electrodes 20, 22 may be RF voltage, DC voltage or a combination thereof and may be different than the voltage applied to the primary electrodes 15, 16. The voltage and/or linear combination of voltages applied to the ring correction electrodes 20, 22 creates a correction potential which corrects the potential deviation caused by the apertures 12, 13 in the end cap electrodes 15, 16. A desirable near ideal quadrupole potential field can be achieved with suitable adjustment of the correction voltage/voltages.

Figure 2:
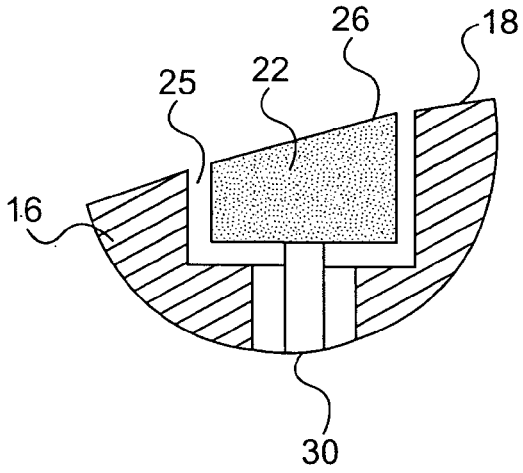
FIG. 2 is a view of a portion of a cross section of an end cap electrode showing one embodiment of the correction electrode.

FIG. 2 shows an enlarged view of a portion of the end cap electrode 16 and ring correction electrode 22. The end cap electrode 16 has groove 25 to accommodate the ring correction electrode 22. Correction electrode connector (e.g. pin) 30 provides for connection of the ring correction electrode 22 to a power supply. The surface 26 of the ring correction electrode 22 is curved to match the hyperbolic curve of the surface 18 of the end cap electrode 16. In the embodiment shown in FIGS. 1 and 2, the curved surface 26 of the ring correction electrode 22 is aligned to be continuous with the curvature 18 of the end cap electrode 16. Although the groove 25 as shown creates a small gap between the ring correction electrode 22 and the end cap 16, the arc of the curvature is continuous.

Figure 3:
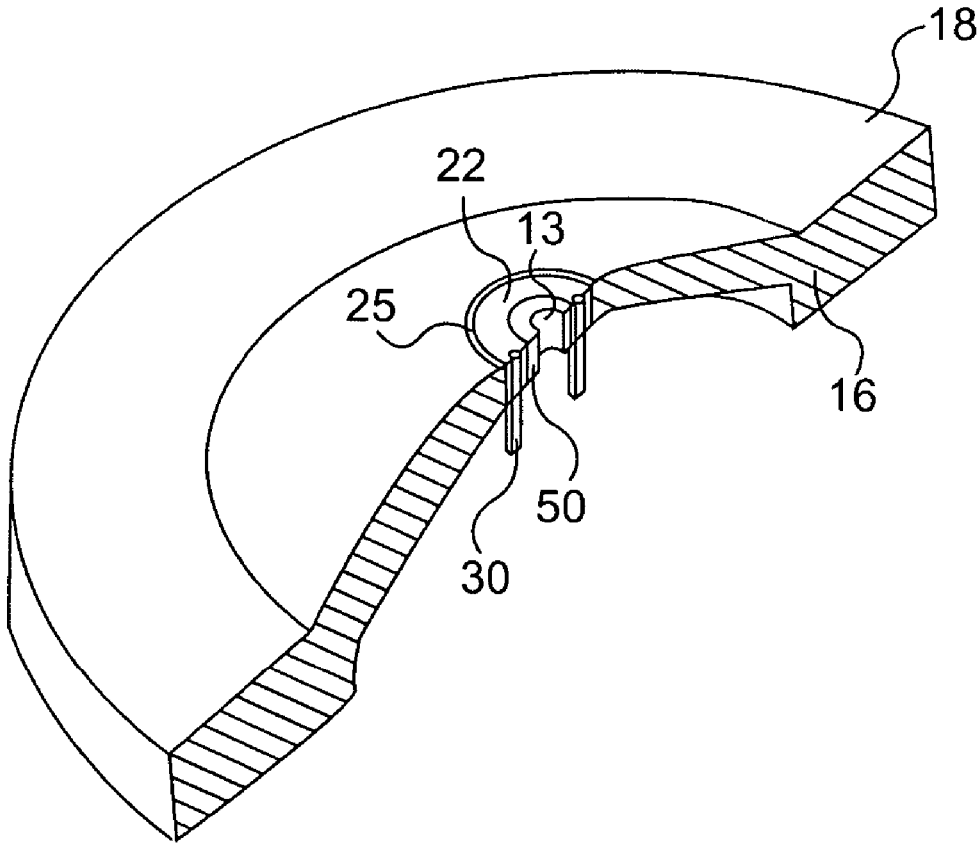
FIG. 3 is a perspective view of an end cap electrode showing one embodiment of the correction electrode.

FIG. 3 shows a perspective view of the end cap electrode 16 with ring correction electrode 22 and correction electrode connector 30. The figure shows about one half of the ring electrode that comprises the ring correction electrode 22. As FIG. 3 shows, a portion 50 of the end cap electrode 16 is interposed between the ring correction electrode 22 and the aperture 13.

For FIGS. 1, 2 and 3, the surface of the ring correction electrodes 20, 22 is shown as a curved surface that matches the hyperbolic curve of the end cap electrodes 15, 16 and is aligned with the hyperbolic curvature of the end cap electrodes 15, 16. This configuration is desirable in some applications. However, this is not necessary. The surface of the ring correction electrodes 20, 22 may be planar. Further, the ring correction electrodes 20, 22 may be positioned to extend above the curved surface of the end cap electrodes 15, 16 or, alternatively, below such that the surface of the ring correction electrodes 20, 22 is below the curved surface of the end cap electrode. (Above the surface of the end cap electrode means that the ring correction electrode extends from the primary electrode in the direction of the trapping volume defined by the primary electrodes. Below the curved surface of the end cap electrode means that none of the ring correction electrode extends into the trapping volume and/or is in continuous alignment with the curved surface of the primary electrode.) Positioning the ring correction electrodes 20, 22 below the surface of the primary electrodes 15, 16 may offer the practical advantage of requiring less precise machining of the correction electrodes.

The ring correction electrodes 20, 22 may be constructed of the same or different materials than the primary electrodes. Suitable electrode materials include for example metals, non-conducting materials with a layer of metal applied to at least one surface and the like. Conventional power supplies which provide for adjustable RF and/or DC voltage to electrodes may be employed as power supplies for supplying the supplemental voltage to the ring correction electrodes 20, 22.

Figure 4:
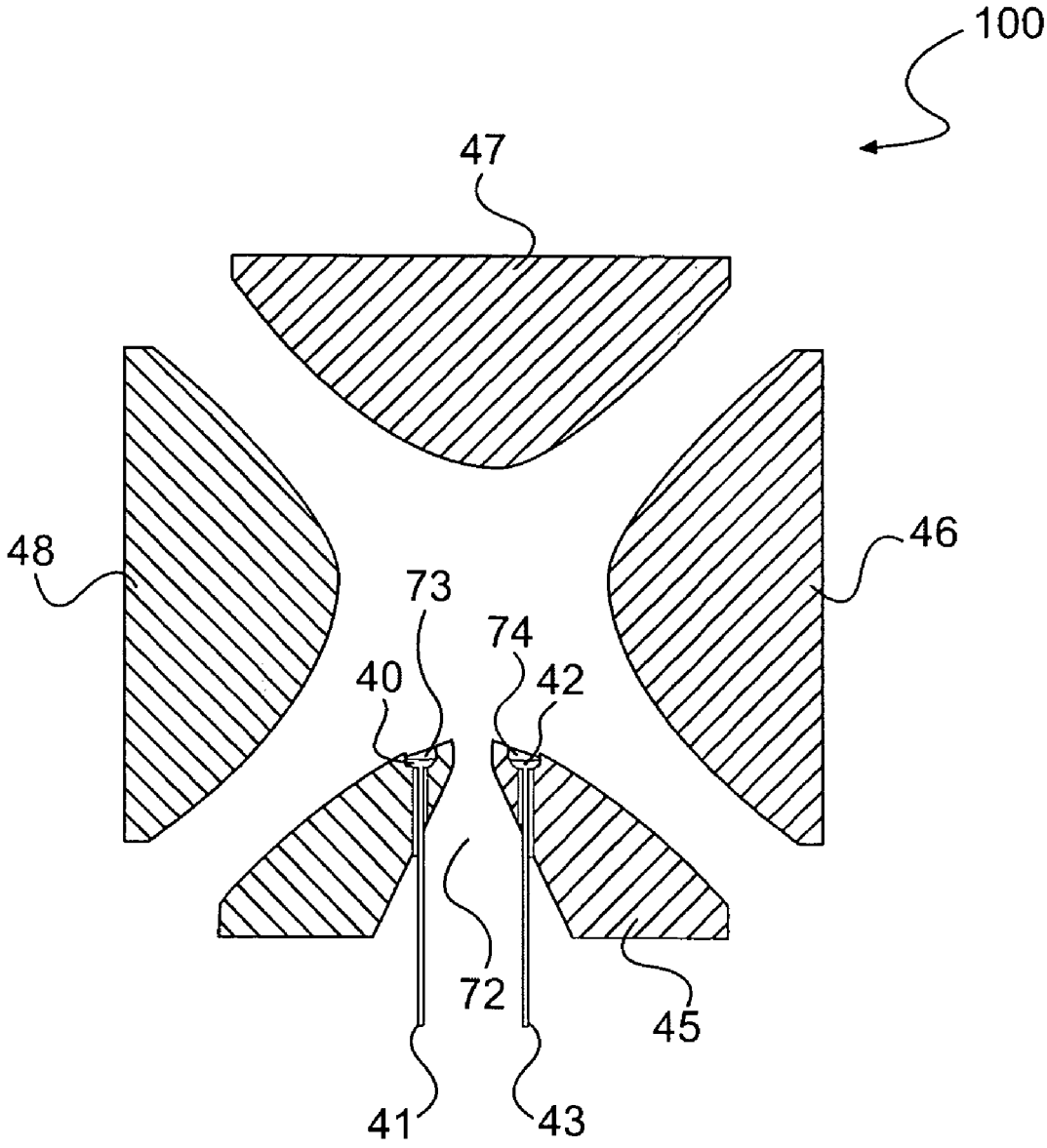
FIG. 4 is a schematic cross section diagram of one embodiment of a linear quadrupole ion trap.

FIG. 4 depicts an exemplary embodiment of the invention in a linear quadrupole ion trap 100. The liner quadrupole ion trap 100 has primary electrodes 45, 46, 47, 48. Primary electrode 45 is a primary electrode with aperture 72 (e.g. aperture electrode). Strip correction electrodes 40, 42 are positioned in aperture electrode 45. In this exemplary embodiment, the strip electrodes 40, 42 are two individual electrodes. A portion of the aperture electrode 45 is interposed between the strip correction electrodes 40, 42 and the aperture 72. Correction electrode connectors 41, 43 are attached to the strip correction electrodes 40, 42 and project from the aperture electrode 45 to provide for attachment of the strip correction electrodes 40, 42 to a power supply.

Figure 5:
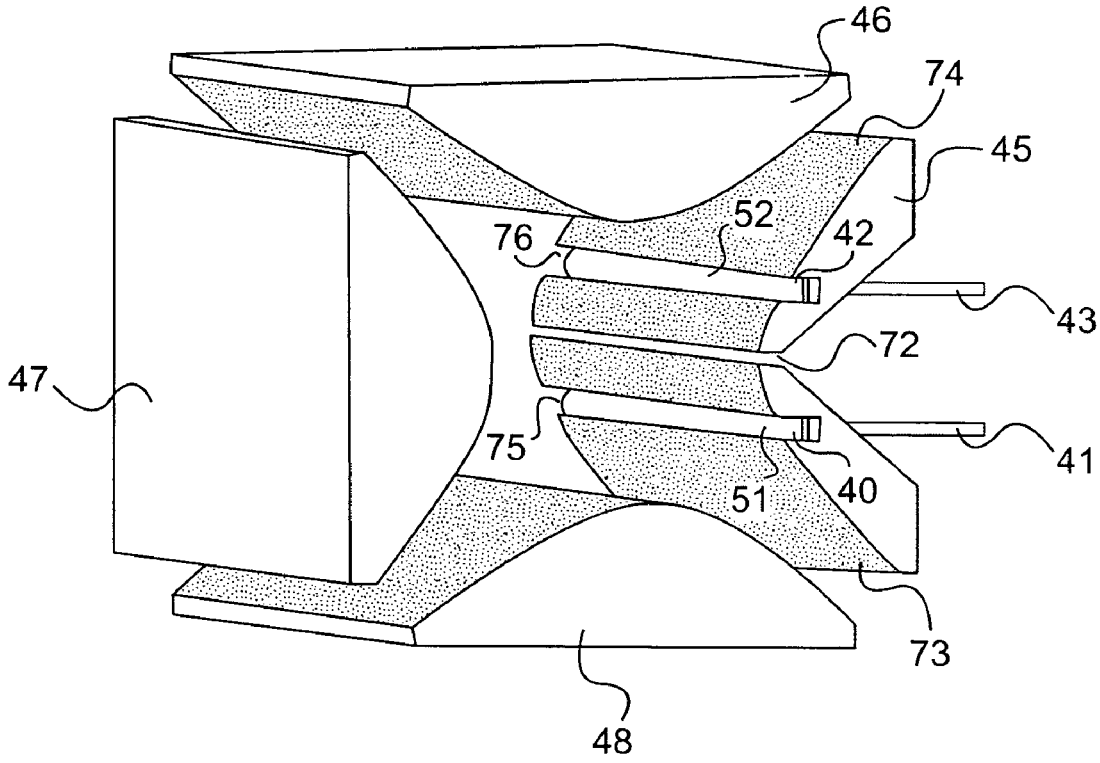
FIG. 5 is a perspective view of one embodiment of a linear quadrupole ion trap.

As seen in FIG. 5, which is a perspective view of the ion trap 100 depicted in FIG. 4, the aperture electrode 45 with aperture 72 is a rod that is slotted along the aperture electrode rod 45 to form an aperture 72 between primarily electrode rod portions 73, 74 of the aperture electrode 45. The aperture 72 is formed in order to permit injection of ions or molecules into the linear quadrupole trap 100. Parallel grooves 75, 76 are constructed in primarily electrode rod portions 73, 74 on each side of the aperture 72 and substantially parallel to the aperture 72. In the embodiment shown in FIG. 5, two strip correction electrodes 40, 42 with hyperbolic surfaces 51, 52 are placed in the grooves 75, 76 and electrically isolated from the quadrupole rod. Pins are mounted on the backside of the strip correction electrodes 40, 42 to hold the electrodes in place and to form correction electrode connectors 41, 43 and provide for electrical connection. Optionally, the strip correction electrodes 40, 42 can be further secured into place by using an appropriate non-conducting adhesive.

An appropriate insulating substrate can be used between the strip correction electrodes 40, 42 and the aperture electrode 45 to provide for electrical isolation of the correction electrodes 40, 42. Ceramic is exemplary of a suitable insulating substrate. This is exemplary and other insulating substance materials may be equally suitable.

RF voltage, DC voltage or a combination thereof may be applied the strip electrodes 40, 42 to provide the correction potential. Conventional power supplies which provide for adjustable RF and/or DC voltage to electrodes may be employed as power supplies for supplying the supplemental voltage to the correction electrodes 40, 42. The voltage applied to the correction electrodes 40, 42 can be controlled and can be adjusted to a voltage different than the voltage used for the primary quadrupole electrode 45. Thus, the strip electrodes 40, 42 provide for an additional potential, which may correct the potential deviation of the quadrupole field caused by the aperture 72.

Figure 6:
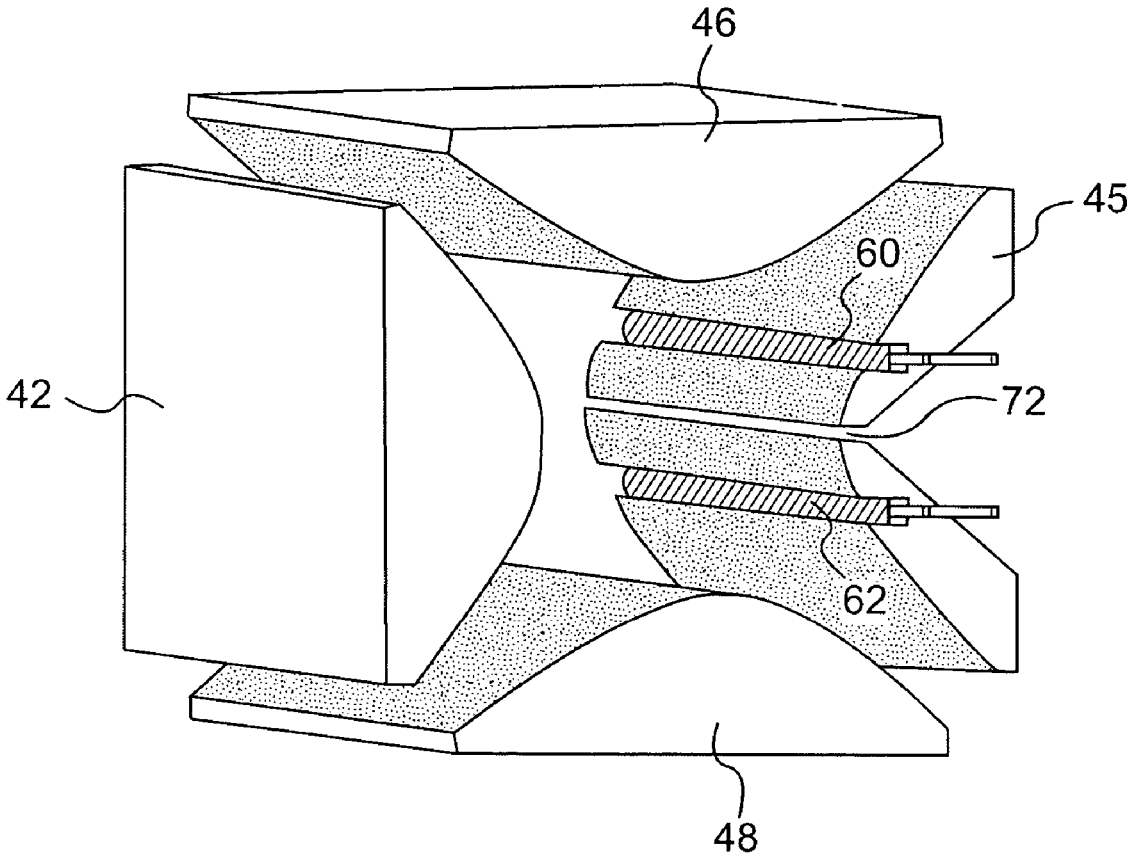
FIG. 6 is a perspective view of one embodiment of a linear quadrupole utilizing a printed circuit correction electrode.

As shown in FIG. 6, the strip electrodes 60, 62 can be a printed circuit board. The printed circuit board may, for example, be a ceramic-based printed circuit board or a flexible printed circuit board such as a printed circuit board on a polyimide substrate. In the embodiment shown in FIG. 6 the strip electrodes 60, 62 are mounted below the surface of primary electrode 45.

Many variations of strip correction electrodes 40, 42 may be used. For example, the surface of the strip correction electrodes 40, 42 may be curved to match the curvature of the surface of the aperture electrode and aligned to conform to the curvature of the surface of the primary electrode 45. Alternatively, as with the ring correction electrodes 20, 22 strip correction electrodes 40, 42 may be positioned above or below the surface of the aperture electrode 45. In some embodiments, the surface of the strip correction electrodes 40, 42 may be planar and accordingly may not necessarily conform to the curvature of the surface of the aperture electrode 45. The strip correction electrodes 40, 42 may be constructed from the same or different materials as the aperture electrode 45. There are various suitable materials for electrode construction such as for example metals, non conducting materials having a layer of metal on at least one surface, and the like.

The strip electrodes 40, 42 are preferably electrically isolated from the aperture electrode 45 and preferably a means is provided to supply a voltage to the strip electrodes 40, 42 different than the voltage to the aperture electrode 45. In some embodiments, it is desirable that voltage be adjustable. Optionally, the voltage to the correction electrodes 40, 42 may be adjustable as an analysis using the ion trap is in progress. Conventional equipment and methods for supplying, controlling and adjusting voltages (e.g. power supplies and the like) may be employed in the practice of the invention.

It is desirable in some embodiments to use strip electrodes 40, 42 in pairs and to arrange them in an arrangement that is symmetric with the aperture 72. An arrangement that is parallel to the aperture 72 is shown herein. This arrangement is exemplary and other arrangements in which the strip correction electrodes 40, 42 are arranged in a symmetric manner with respect to the aperture may be used.

Further, the illustrated examples show one pair of strip correction electrodes 40, 42. In some embodiments, it may be desirable to use multiple pairs of strip correction electrodes 40, 42 or strip correction electrodes 40, 42 in combination with one or more ring correction electrodes 20, 22 or one or more ring correction electrodes 20, 22. When multiple correction electrodes are used, all ring correction electrodes 20, 22 are preferably positioned to be coaxial with the aperture 12, 13 and strip correction electrodes 40, 42 are preferably positioned symmetrically with respect to the aperture 72. Multiple pairs of strip correction electrodes, multiple ring correction electrodes or combinations of ring and strip correction electrodes may be desirable for facilitating optimization of specific features.

The 3-D and linear ion traps described herein may be used as mass spectrometers. In addition to the ion trap the mass spectrometer may further comprise an ion source and a detector.

The foregoing discussion discloses and describes many exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

The invention claimed is:

1. A quadrupole ion trap comprising:

a plurality of primary electrodes defining a trapping volume, wherein the primary electrodes include a first primary electrode having an aperture; and a correction electrode wherein the correction electrode is positioned in the first primary electrode having an aperture such that a portion of the first primary electrode is interposed between the aperture and the correction electrode.

2. The quadrupole ion trap of claim 1 further comprising a voltage source wherein the source is operable to apply a supplemental voltage to the correction electrode.

3. The quadrupole ion trap of claim 2 wherein the supplemental voltage is selected from the group consisting of RF voltage, DC voltage and a combination thereof.

4. The quadrupole ion trap of claim 2 wherein the voltage source is adjustable to apply a voltage to the correction electrode different from a voltage applied to the first primary electrode.

5. The quadruple ion trap of claim 2 wherein the voltage source is adjustable to vary the supplemental voltage during operation of the quadrupole ion trap.

6. The quadrupole ion trap of claim 1 wherein the correction electrode is at least one ring electrode and the at least one ring electrode is coaxial with the aperture.

7. The quadrupole ion trap of claim 1 wherein the correction electrode comprises a plurality of strip electrodes and wherein the plurality of strip electrodes are positioned symmetrically with respect to the aperture.

8. The quadruple ion trap of claim 7 wherein the first primary electrode with aperture is grooved with at least one electrode groove on each side of the aperture and wherein each electrode groove contains at least one strip electrode.

9. The quadrupole ion trap of claim 1 wherein at least a portion of the plurality of the strip electrodes comprise a printed circuit board.

10. The quadrupole ion trap of claim 1, wherein the surface of the correction electrode is a planar.

11. The quadrupole ion trap of claim 1 wherein the first primary electrode has at least one curved surface positioned adjacent the trapping volume and the correction electrode has at least one curved side, the curved side having substantially the same curvature as the curved surface of first primary electrode and wherein the correction electrode is positioned such that the curvature of the curved side substantially conforms to the curved surface of the first primary electrode.

12. The quadrupole ion trap of claim 1 wherein the first primary electrode has at least one curved surface positioned adjacent the trapping volume and wherein the correction electrode is positioned below the curved surface of the first primary electrode.

13. The quadrupole ion trap of claim 1 wherein the first primary electrode has at least one curved surface positioned adjacent the trapping volume and wherein at least a portion of the correction electrode is above the curved surface of the first primary electrode.

14. A mass spectrometer comprising:

a plurality of primary electrodes defining a trapping volume and wherein the plurality of primary electrodes include a first end cap electrode comprising a first aperture; and a first correction electrode positioned in the first end cap electrode, wherein the first correction electrode is positioned at a distance from the first aperture such that a portion of the first end cap electrode is interposed between the first aperture and the first correction electrode.

15. The mass spectrometer of claim 14 further comprising a second end cap electrode comprising a second aperture and a second correction electrode wherein the second correction electrode is positioned at a distance from the second aperture such that a portion of the second end cap electrode is interposed between the second aperture and the second correction electrode.

16. The mass spectrometer of claim 14 wherein the at least one correction electrode is selected from the group consisting of ring electrodes, strip electrodes and combinations thereof.

17. The mass spectrometer of claim 14 wherein a surface of the first correction electrode is curved in the same curvature as a surface of the first end cap electrode and wherein the curved surface of the first correction electrode is aligned to conform to the curvature of the surface of the first end cap electrode.

18. The mass spectrometer of claim 14 further comprising a means for applying a supplemental voltage to the first correction electrode and wherein the supplemental voltage is adjustable and is selected from the group consisting of RF voltage, DC voltage and a combination thereof and wherein the means for applying supplemental voltage is adjustable to apply a voltage to the first correction electrode different from a voltage applied to the first end cap electrode.

19. A method for applying a field correction in a quadrupole potential distribution comprising:

providing a quadrupole ion trap comprising a plurality of primary electrodes defining a trapping volume, wherein the primary electrodes include a first primary electrode having an aperture, and a correction electrode wherein the correction electrode is positioned in the primary electrode having an aperture such that a portion of the primary electrode is interposed between the aperture and the correction electrode, and applying a supplemental voltage to the correction electrode wherein the supplemental voltage has an adjustment means, the adjustment means providing adjustment of the supplemental voltage to a voltage different from a voltage applied to the first primary electrode wherein a field correction is provided in the trapping volume.

20. The method of claim 19 wherein the supplemental voltage is selected from the group consisting of RF voltage, DC voltage and a combination thereof.

* * * * *